US007914180B2

(12) United States Patent
Lee

(10) Patent No.: US 7,914,180 B2
(45) Date of Patent: Mar. 29, 2011

(54) LAMP REFLECTOR

(76) Inventor: Wen-Sung Lee, Taichung (TW)

( * ) Notice: Subject to any disclaimer, the term of this patent is extended or adjusted under 35 U.S.C. 154(b) by 78 days.

(21) Appl. No.: 12/491,197

(22) Filed: Jun. 24, 2009

(65) Prior Publication Data

US 2010/0328959 A1 Dec. 30, 2010

(51) Int. Cl.
*F21V 7/00* (2006.01)

(52) U.S. Cl. ..... 362/341; 362/346; 362/296.01; 362/310; 362/296.05; D26/118

(58) Field of Classification Search ..... 362/146–149, 362/346–349, 296.01, 296.05–296.08, 297, 362/304, 310, 296.09, 341; D26/118
See application file for complete search history.

(56) References Cited

U.S. PATENT DOCUMENTS

| | | | | |
|---|---|---|---|---|
| 1,639,363 | A * | 8/1927 | Balsillie | 362/348 |
| 3,401,258 | A * | 9/1968 | Guth | 362/349 |
| 2006/0268556 | A1* | 11/2006 | Hsieh | 362/347 |
| 2007/0279908 | A1* | 12/2007 | Alcelik | 362/283 |

* cited by examiner

*Primary Examiner* — Robert May

(57) ABSTRACT

A lamp reflector includes a reflector cup having an enlarged end and a narrow end being opposite to the enlarged end. The narrow end gradually is expanded toward the enlarged end. The reflecting cup has multiple tiers longitudinally formed thereon along the axis. Each tier has a convex surface annularly formed on an inner periphery thereof for scattering light beams emitted from different angles. Each convex surface has multiple concave faces respectively radially formed thereon for condensing light beams emitted from different angles.

4 Claims, 5 Drawing Sheets

LAMP REFLECTOR

BACKGROUND OF THE INVENTION

1. Field of the Invention

The present invention relates to a reflector, and more particularly to a lamp reflector having multiple concave faces and multiple convex surfaces.

2. Description of Related Art

A conventional lamp reflector includes a reflecting cup provided for a light emitting diode device. The reflecting cup has an installing portion and the reflecting portion. A light emitting diode lamp is mounted on the installing portion. The reflecting portion has a high reflecting film formed thereon. The high reflecting film is formed by metallic coating. Wherein the reflecting portion reflects multiple lights emitted by the light emitting diode lamp for concentratedly projecting the multiple light beams toward a same direction.

However, human eyes are injured due to the glare of the multiple light beams concentrated by the conventional lamp reflector. The multiple light beams are concentratedly projected in the same direction to form a bright section in a center and a dim section around the bright section such that the human eyes are easily uncomfortable in between the bright section and the dim section. The conventional lamp reflector may not provide a uniformly illuminating effect.

The present invention has arisen to mitigate and/or obviate the disadvantages of the conventional lamp reflector.

SUMMARY OF THE INVENTION

The main objective of the present invention is to provide an improved lamp reflector.

To achieve the objective, a lamp reflector in accordance with the present invention comprises a reflecting cup. The reflecting cup has a trumpet-shaped structure having an enlarged end and a narrow end being opposite to the enlarged end. The reflecting cup has an axis passing through the enlarged end and the narrow end thereof. The narrow end is gradually expanded toward the enlarged end. The reflecting cup has a first tier disposed adjacent to the narrow end, a third tier disposed adjacent to the enlarged end, and a second tier disposed between the first tier and the third tier. The first tier has a first convex surface annularly formed on an inner periphery thereof. The first convex surface axially curvilinearly extends from the narrow end toward the enlarged end and is convex toward the axis of the reflector cup. The second tier has a second convex surface annularly formed on an inner periphery thereof. The second convex surface axially curvilinearly extends from the narrow end toward the enlarged end and is convex toward the axis of the reflector cup. The third tier has a third convex surface annularly formed on an inner periphery thereof. The third convex surface axially curvilinearly extends from the narrow end toward the enlarged end and is convex toward the axis of the reflector cup. The first convex surface, the second convex surface, and the third convex surface are curvature-discontinuously arranged to one another. Each of the first convex surface, the second convex surface and the third convex surface has multiple concave faces respectively radially formed on thereon. Each concave face axially extends from the narrow end to the enlarged end. Each concave face is discontinuous to an adjacent concave face in a same diameter of the reflecting cup. The first tier has an axial length shorter than that of the second tier and the second tier has an axial length shorter than that of the third tier. An amount of the multiple concave faces on the third convex surface is greater than an amount of the multiple concave faces on the second convex surface and an amount of the multiple concave faces on the first convex surface.

Further benefits and advantages of the present invention will become apparent after a careful reading of the detailed description with appropriate reference to the accompanying drawings.

DETAILED DESCRIPTION OF THE INVENTION

Figure 1:
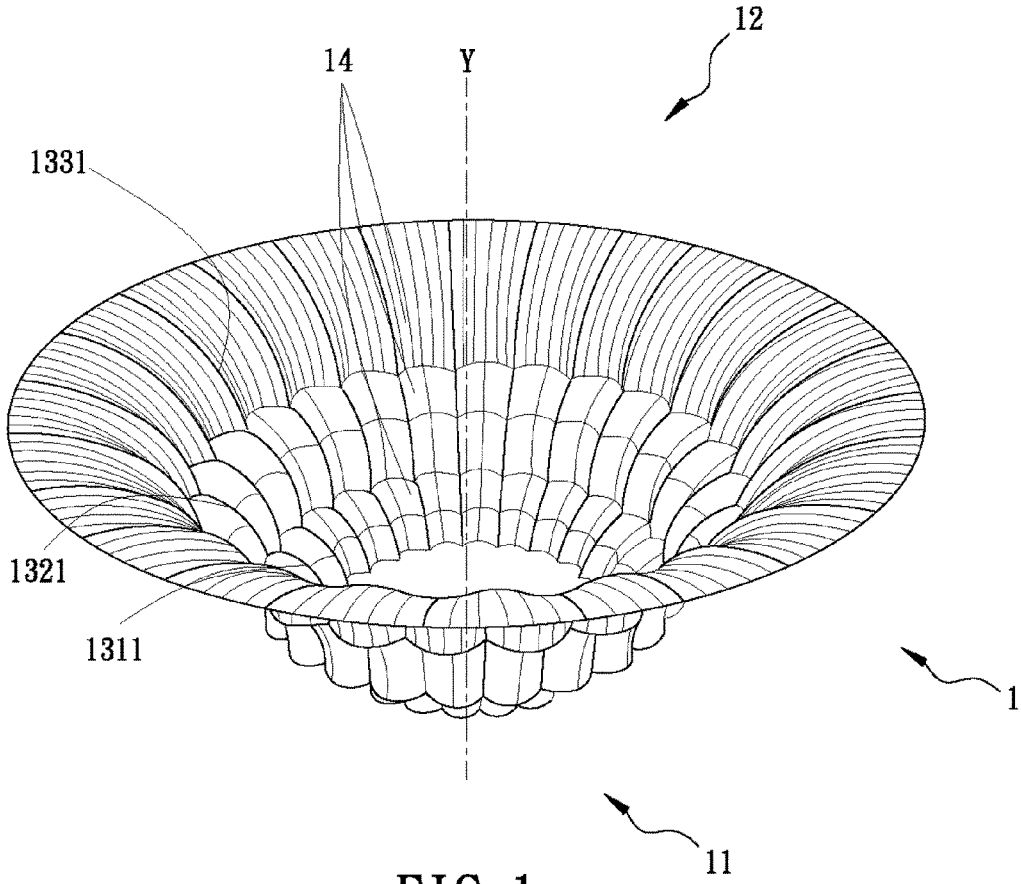
FIG. 1 is a perspective view of a lamp reflector in accordance with the present invention.
Figure 2:
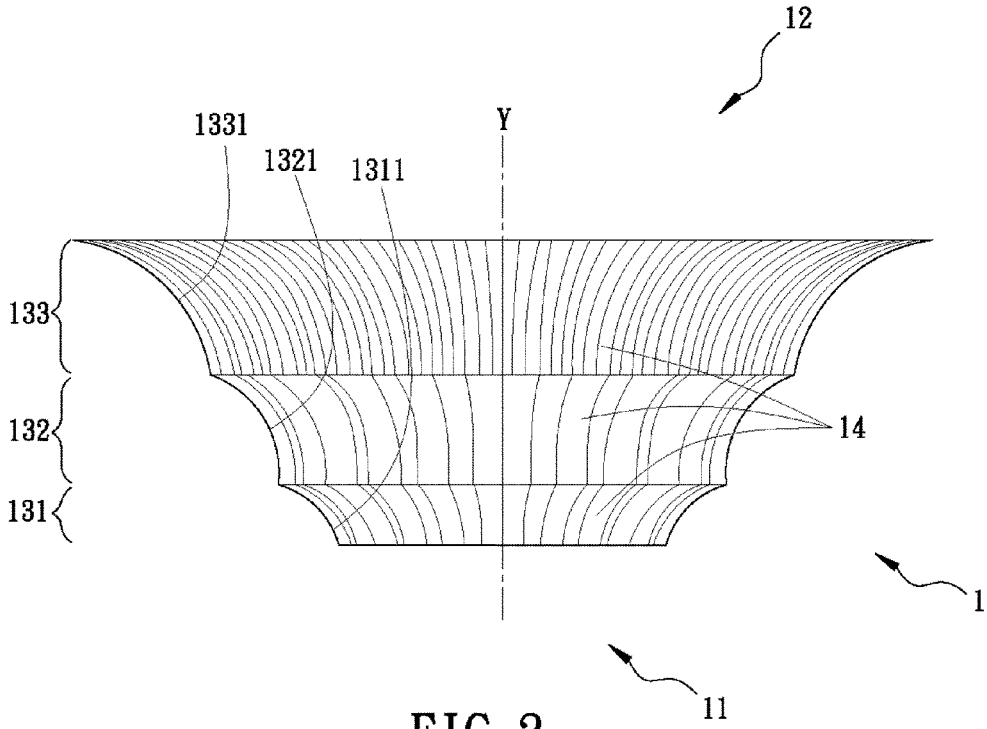
FIG. 2 is a side plane view of the lamp reflector in accordance with the present invention.
Figure 3:
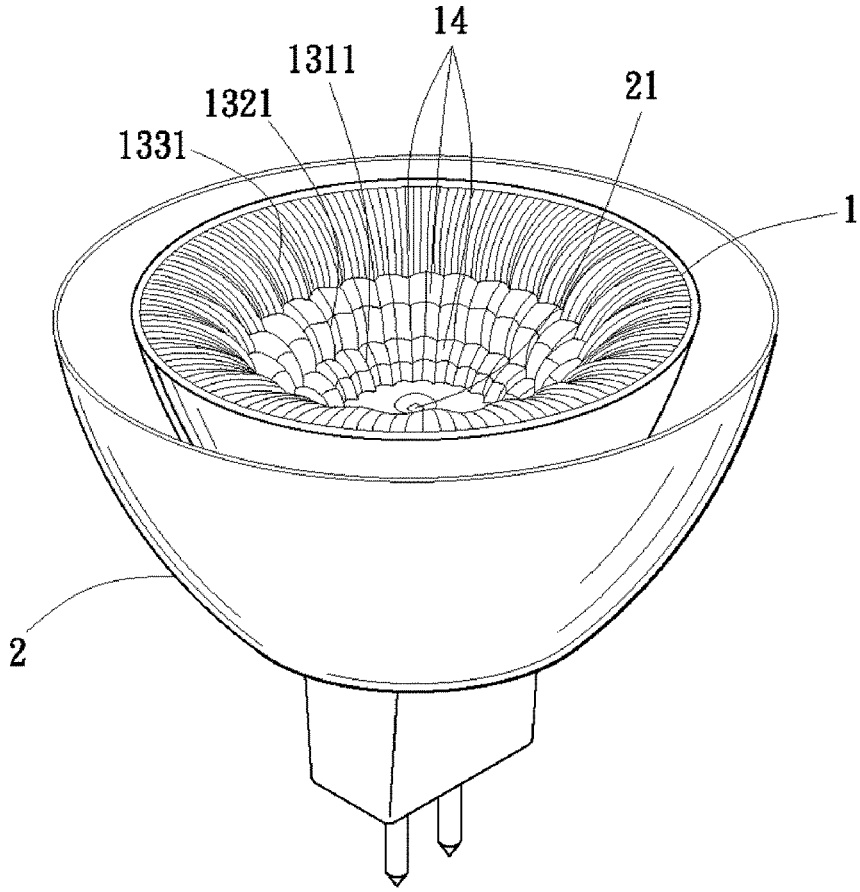
FIG. 3 is an assembled perspective view of the lamp reflector in accordance with the present invention mounted on an illuminator.

Referring to the drawings and initially to FIGS. 1-4, a lamp reflector in accordance with the present invention comprises a reflecting cup (1).

The reflecting cup (1) has a trumpet-shaped structure having an enlarged end (12) and a narrow end (11) being opposite to the enlarged end (12). The reflecting cup (1) has an axis (Y) passing through the enlarged end (12) and the narrow end (11) thereof. The enlarged end (12) is provided for projecting light beams. The narrow end (11) is provided for mounting on an illuminator (2) and positioning a lamp (21) on a center thereof. In the preferred embodiment of the present invention, the lamp (21) is a light emitting diode lamp. The narrow end (11) is gradually expanded toward the enlarged end (12). The reflecting cup (1) has multiple tiers longitudinally formed thereon along the axis (Y). In the preferred embodiment of the present invention, the reflecting cup (1) has a first tier (131) disposed adjacent to the narrow end (11), a third tier (133) disposed adjacent to the enlarged end (12), and a second tier (132) disposed between the first tier (131) and the third tier (133). The first tier (131) has a first convex surface (1311) annularly formed on an inner periphery thereof. The first convex surface (1311) axially curvilinearly extends from the narrow end (11) toward the enlarged end (12) and is convex toward the axis (Y) of the reflector cup (1). The second tier (132) has a second convex surface (1321) annularly formed on an inner periphery thereof. The second convex surface (1321) axially curvilinearly extends from the narrow end (11) toward the enlarged end (12) and is convex toward the axis (Y) of the reflector cup (1). The third tier (133) has a third convex surface (1331) annularly formed on an inner periphery thereof. The third convex surface (1331) axially curvilinearly extends from the narrow end (11) toward the enlarged end (12) and is convex toward the axis (Y) of the reflector cup (1). The first convex surface (1311), the second convex surface (1321), and the third convex surface (1331) are curvature-discontinuously arranged to one another. Each of the first convex surface (1311), the second convex surface (1321), and the third convex surface (1331) is provided for scattering light beams emitted from different angles. Each of the first convex surface (1311), the second convex surface (1321), and the third convex surface (1331) has a predefined curvature which is based on an emitting angle of the lamp (21). The curvature of each of the first convex surface (1311), the second convex surface (1321), and the third convex surface (1331) can be changed for coordinating a different lamp. Each of the first convex surface (1311), the second convex surface (1321) and the third convex surface (1331) has multiple concave faces (14) respectively radially formed thereon Each concave face (14) axially extends from the narrow end (11) to the enlarged end (12). Each concave face (14) is curvature-discontinuous to an adjacent concave face (14) in the same concave surface of the reflecting cup (1). Each of the multiple concave faces (14) is provided for condensing light beams emitted from different angles. Each concave face (14) has a predefined curvature which is based on the emitting angle of the lamp (21). The curvature of each concave face (14) can be changed for coordinating the different lamp.

The first tier (131) has an axial length shorter than that of the second tier (132) and the second tier (132) has an axial length shorter than that of the third tier (133) for coordinating emitting directions of the light beams. An amount of the multiple concave faces (14) on the third convex surface (1331) is greater than an amount of the multiple concave faces (14) on the second convex surface (1321) and an amount of the multiple concave faces (14) on the first convex surface (1311). Therefore, the light beams emitted from the lamp (21) are scatteredly reflexed by the first, second, and third convex surfaces (1311, 1321, and 1331) for uniformly reflecting the light beams.

Figure 4:
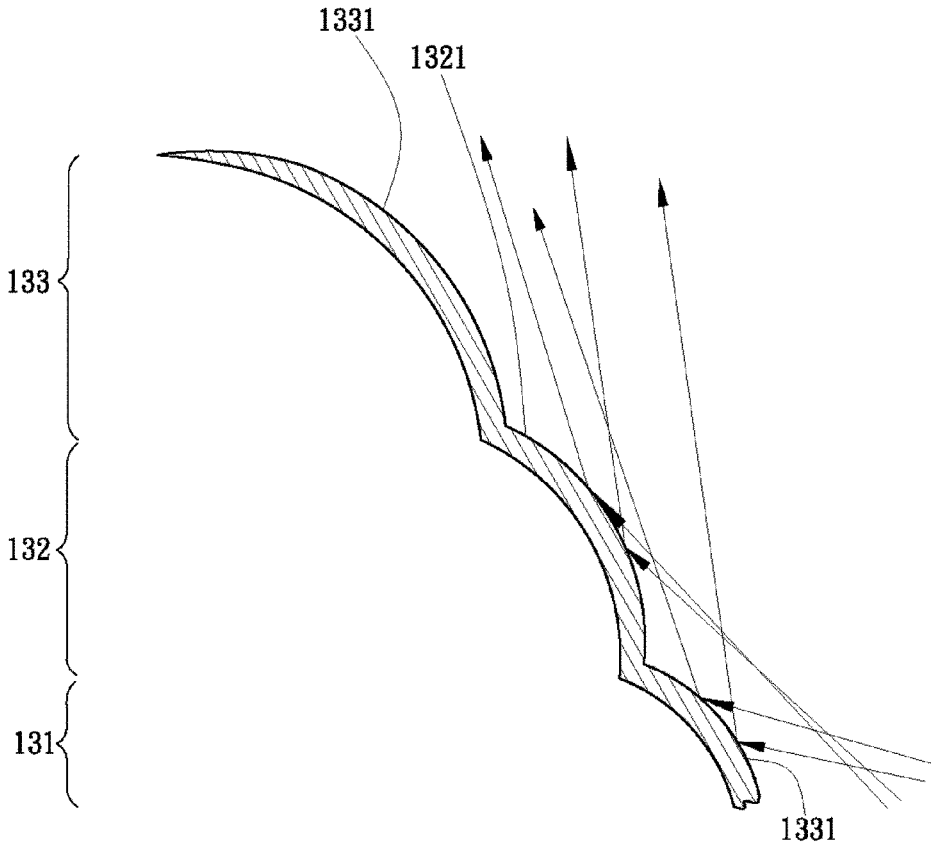
FIG. 4 is a cross-sectional view of the lamp reflector in accordance with the present invention.

With reference to FIG. 4, the light beams scattered by the first convex surface (1311), the second convex surface (1321), and the third convex surface (1331) are integrally forced in a distance such that the light beams are uniformly projected. The light beams condensed by the multiple concave faces (14) are scattered after the light beams passing a focus of the multiple concave faces (14) such that the light beams are uniformly projected.

Figure 5:
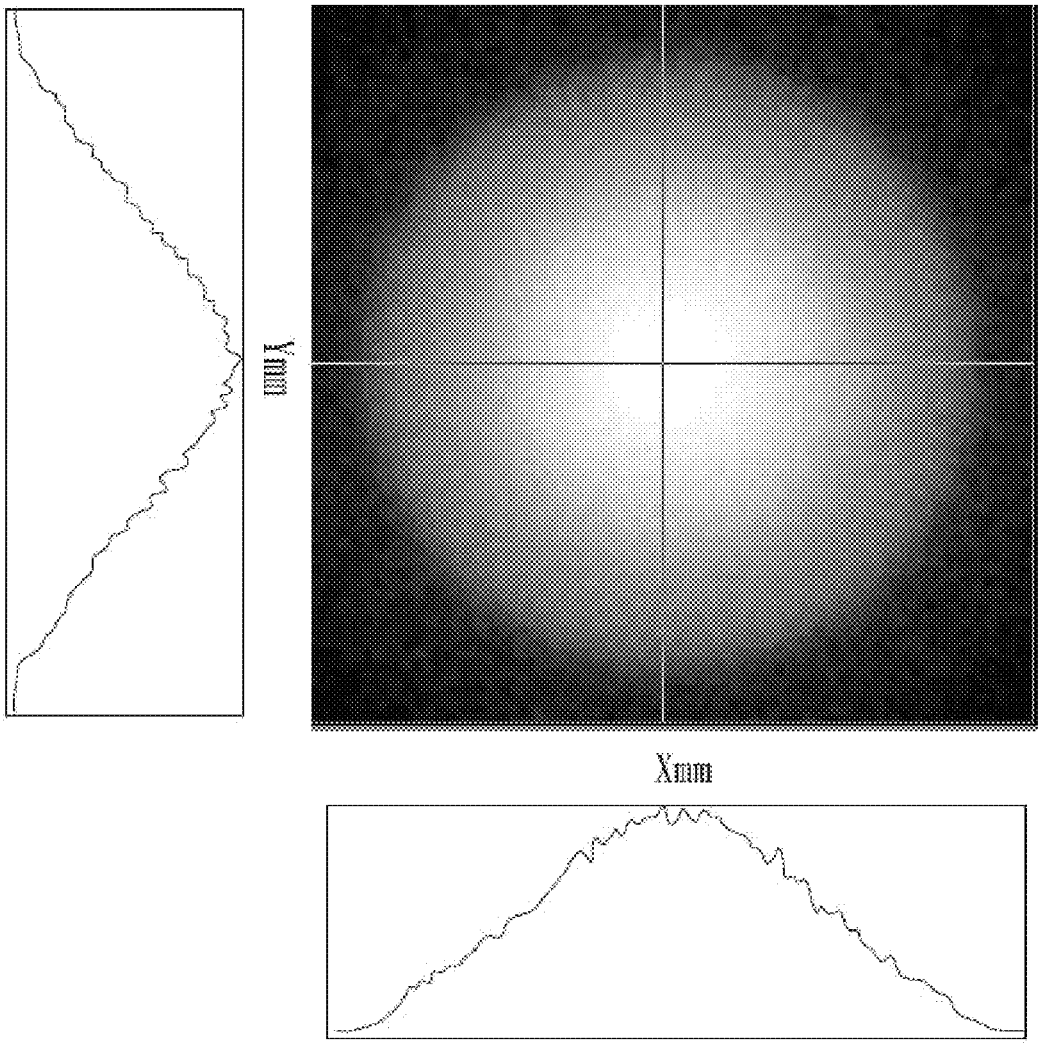
FIG. 5 is a photograph of a light pattern projected on a screen, by the lamp reflector in accordance with the present invention, which has two wave patterns respectively show the distributions of the photograph in X-axis and Y-axis.

With reference to FIG. 5, a photograph of a light pattern is projected on a screen by the lamp reflector in accordance with the present invention having two wave patterns respectively shown the distributions of the photograph in X-axis and Y-axis. Each of the wave patterns in X-axis and Y-axis has a smooth curved wave (not numbered) and two gradual slopes positioned two sides of the curved wave for showing the light beams being uniformly projected.

Although the invention has been explained in relation to its preferred embodiment, it is to be understood that many other possible modifications and variations can be made without departing from the spirit and scope of the invention as hereinafter claimed.

What is claimed is:

1. A lamp reflector comprising:

a reflecting cup having a trumpet-shaped structure having an enlarged end and a narrow end being opposite to the enlarged end, the reflecting cup having an axis passing through the enlarged end and the narrow end thereof, the enlarged end provided for projecting light beams and the narrow end provided for adapting to position a lamp, the narrow end gradually expanded toward the enlarged end, the reflecting cup having multiple tiers longitudinally formed thereon along the axis, each tier having a convex surface annularly formed on an inner periphery thereof, each convex surface axially curvilinearly extending from the narrow end toward the enlarged end and being convex toward the axis of the reflector cup for scattering light beams emitted from different angles, each convex surface and an adjacent convex surface of different tier curvature-discontinuously arranged to each other, each convex surface having multiple concave faces respectively radially formed thereon, each concave face axially extending from the narrow end to the enlarged end for condensing light beams emitted from different angles, each concave face being curvature-discontinuous to an adjacent concave face in the same convex surface.

2. The lamp reflector as claimed in claim 1, wherein the multiple tiers has a first tier disposed adjacent to the narrow end, a third tier disposed adjacent to the enlarged end, and a second tier disposed between the first tier and the third tier.

3. The lamp reflector as claimed in claim 1, wherein each tier being adjacent to the narrow end has an axial length shorter than the tier being adjacent to the enlarged end for coordinating emitting directions of the light beams.

4. The lamp reflector as claimed in claim 1, wherein an amount of the multiple concave faces of the convex surface being adjacent to the enlarged end is greater than an amount of the multiple concave faces of the convex surface being adjacent to the narrow end.

* * * * *